US006031509A

United States Patent [19]

Kaitani

[11] Patent Number: 6,031,509

[45] Date of Patent: Feb. 29, 2000

[54] SELF-TUNING MATERIAL FOR SELECTIVELY AMPLIFYING A PARTICULAR RADIO WAVE

[75] Inventor: Etsuko Kaitani, Osaka, Japan

[73] Assignee: Suisaku Limited, Japan

[21] Appl. No.: 09/029,113

[22] PCT Filed: Sep. 11, 1996

[86] PCT No.: PCT/JP96/02594

§ 371 Date: Feb. 18, 1998

§ 102(e) Date: Feb. 18, 1998

[87] PCT Pub. No.: WO97/10624

PCT Pub. Date: Mar. 20, 1997

[30] Foreign Application Priority Data

Sep. 13, 1995 [JP] Japan ..... 7-262269

[51] Int. Cl.[7] ..... H01Q 15/14

[52] U.S. Cl. ..... 343/912; 428/328

[58] Field of Search ..... 343/909, 912; 428/328

[56] References Cited

U.S. PATENT DOCUMENTS

| | | | |
|---|---|---|---|
| 2,840,820 | 6/1958 | Southworth | 343/909 |
| 4,734,140 | 3/1988 | Tzeng | 148/513 |
| 5,147,718 | 9/1992 | Papoulias et al. | 428/328 |
| 5,366,691 | 11/1994 | Takeda et al. | 420/548 |
| 5,789,064 | 8/1998 | Valente et al. | 428/328 X |

*Primary Examiner*—Robert Pascal
*Assistant Examiner*—Justin P. Bettendorf
*Attorney, Agent, or Firm*—Morrison Law Firm

[57] ABSTRACT

Self-tuning materials which can efficiently emit or receive radio waves in spite of being simple in their construction and small in their dimension, and are applied to patch antenna, wave directors or the like. Metallic chips containing two or more kinds of ingredients which are distributed in a layered, net-like or needle-shaped configuration, and an organic or inorganic bonding material which is small in dissipation of electric power under radio waves of high frequencies are mixed with each other, and are pressurized under a high pressure while being highly electrified in the direction perpendicular to the pressurizing direction to mold the metallic chips and the bonding material in a plate-shaped configuration while being heated.

6 Claims, 4 Drawing Sheets

SELF-TUNING MATERIAL FOR SELECTIVELY AMPLIFYING A PARTICULAR RADIO WAVE

TECHNICAL FIELD

The present invention relates to self-tuning materials in a plate-shaped configuration, which are small in their dimension and simple in their construction, selectively emit or receive particular radio waves only and absorb any unnecessary radio waves. The self-tuning materials are used in the form of patch antenna, wave directors or the like in mobile or stationary type radio or wireless communication devices for the use of a microwave or millimetric wave band.

TECHNICAL BACKGROUND

The mobile type radio or wireless communication devices such as automotive telephones, portable wireless telephones or the like are coming into wide use, because they allow communication to be feasible regardless of time and place. The propagational characteristics of radio waves differ according to their frequencies, and the radio waves attenuate in their propagational energy, and decrease in their reaches as their frequencies are elevated. Therefore, the radio waves are difficult to propagate in areas or places blocked by buildings or mountains when the radio waves belong to the microwave or the millimetric wave band which is applied in the field of the mobile radio or wireless communication. Moreover, in the microwave or the millimetric wave band, the radio waves are damped in their propagational energy owing to rain, fog or mist, and this denotes that radio waves of high frequencies in the microwave or the millimetric wave band come to approach light in their properties.

In this case, the foregoing trouble in which the radio waves are difficult to propagate can easily be mitigated if the radio waves are strengthened in their propagational energy to emit them. However, this countermeasure can by no means be accepted if the radio waves cause a harmful effect on the human body. Particularly, in polyclinics which are equipped with a great number of electronic medical systems, the radio waves emitted cause the electronic medical systems to malfunction, and this is a subject of public discussion.

Therefore, it is completely out of the question to strengthen the propagational energy of the radio waves to be emitted from the mobile type radio or wireless communication devices.

In Japan, many of the mobile type radio or wireless communication devices use radio waves of 100 MHz or more in their frequencies, and for example, the automotive digital wireless telephones or the portable wireless telephones employ radio waves chiefly of 1.5 GHz rather than 800 MHz in their frequencies. Also, in a simpler portable digital wireless telephone called PHS in Japan which stand for Personal Handy Phone System, a radio wave of 1.9 GHz in the frequency thereof is applied.

The digital type radio or wireless communication is wider in the occupied band width of frequency thereof than the analogue type radio or wireless communication, and it is difficult to take many communicating channels for the digital type radio or wireless communication. However, as compared with the analogue type communication in which the communicating quality suddenly deteriorates as the radio wave under reception becomes faint, the digital type communication less deteriorates in the communicating quality to some level of field intensity of the radio wave.

Generally, in the digital type portable radio or wireless telephones for which a radio wave of 1.5 GHz in the frequency thereof is used, the communicating unit area comprises small zones of 5 km to 10 km in radius, and a base station is required to be located every three zones in their intersecting points. For example, when the digital type portable radio or wireless telephones which are operated in the district of Osaka Prefecture are brought into that of Fukui Prefecture in Japan, such telephones deteriorate in their communicating performance, and become finally incapable of their communicating operation, because these two districts are different service areas of the telephone company.

Also, the digital type portable wireless telephones can readily be affected by surrounding noises, and within manufacturing factories and automobiles in which there are a great deal of noises, it becomes frequently difficult to allow the communicating operation of the digital type portable radio or wireless telephones.

Moreover, the television uses radio waves of 30 to 3000 MHz in their frequencies for the electric signals thereof, and the automotive television deteriorates in its reception of the radio waves when, for example, it is moved along the skirts of mountains.

The present invention is submitted to improve the foregoing disadvantages of the mobile or stationary type radio or wireless communication devices which use a microwave band or a millimetric wave band.

OBJECTS OF THE INVENTION

It is an object of the present invention to provide a self-tuning material with densely coupled metallic chips which creates a resonance circuit upon the introduction of a radio wave.

It is another object to provide a self-tuning material of metallic chips coupled to one another and a coil connected thereto.

It is a still further object of the present invention to provide a method for manufacturing a self-tuning circuit including mixing metallic chips with a bonding material, applying a predetermined pressure to the resultant mixture, heat molding the resultant mixture, and applying an electric current through the resultant mixture in a direction orthogonal to the application of the pressure.

An object of the present invention is to provide for a self-tuning material which only amplifies a particular radio wave before it is emitted or after it is received.

Another object of the present invention is to provide for a self-tuning material in a plate-shaped configuration which achieves more efficient amplification of a particular radio wave alone before it is emitted or after it is received by connecting a resonance coil thereto.

Still another object of the present invention is to provide for a small-sized self-tuning material which is applied to mobile radio or wireless communication devices used for emission or reception of radio waves in a microwave band or a millimetric wave band.

Still another object of the present invention is to provide for an efficient method for manufacturing self-tuning materials of high performance.

Yet another object of the present invention is to provide for a method for manufacturing self-tuning materials while a high electric current of high voltage is applied to them so that they are furnished with even or identical electric characteristics on their whole surfaces.

Briefly stated, A self-tuning material has metallic chips of two or more ingredients distributed in a layered, net-like or needle-shaped configuration. A bonding material which has the property of having a small dissipation of electric power under radio waves of high frequencies is mixed with the metallic chips. The final mixture is pressurized and highly electrified in directions orthogonal to one another.

These and other objects, characters and advantages of the present invention will be more apparent to those engaged in the art from the following description.

DISCLOSURE OF INVENTION

As illustrated in FIG. 1 of the accompanying drawings, a self-tuning material of the present invention is a material in a plate-shaped configuration, comprising metallic chips 2 which are densely coupled with one another under the effect of surface diffusion, and respectively contain two or more kinds of ingredients, and organic or inorganic bonding materials which keep the metallic chips 2 joined to one another. The metallic chips denote granular bodies or shavings of metal of a single element or of an alloy, or the like. In FIG. 1, the self-tuning material 1 is a simple continuous body of the metallic chips 2, and this self-tuning material may have both ends of a resonance coil 7 connected thereto as shown in FIG. 2. Alternatively, the self-tuning material may be a porous sintered body 8.

The resonance frequency of the self-tuning material 1 becomes still higher when the metallic chips 2 in the form of granular bodies are smaller in their diameters. As said granular bodies 2 are 10 to 30 mesh in their grain size, for example, the self-tuning material 1 comprising the granular bodies 2 can be applied to radio or wireless communication devices which use radio waves of 300 to 3,000 Mhz in their frequencies. The self-tuning material which comprises the granular bodies 2 of 30 to 40 mesh in their grain size can be applied to radio or wireless communication devices employing radio waves of 1,700 to 5,000 MHz in their frequencies.

In general, the metallic chips 2 are alloys having ingredients 3 and 4 as is apparent from FIG. 1 or 3. The metallic chips 2 may comprise in mixture a plurality of chips of different ingredients.

In the metallic chips 2, it is preferable that the ingredients 3 have a small amount of ingredients 4 distributed over them in a layered, net-like, needle-shaped configuration or other similarly shaped configuration. The ingredients 3 and 4 are required to differ in their electric charges.

As the materials for the metallic chips 2, a hyper-eutectic aluminum-silicon alloy or a carbon steel (Fe—C) may be exemplified. That is to say, the ingredients 3 may be aluminum, iron or the like and the ingredients 4 may be carbon, silicon or the like. As the materials for the metallic chips 2, other metallic alloys such as cast iron may be used, which contain three or more kinds of ingredients 3 and 4 including iron, carbon, silicon, manganese and other elements. However, it is not preferable that any alloy containing metal element having large electric resistance as a material for the metallic chips.

In order to form an applicable chip 2, a certain kind of metallic chip may be arranged to be electroplated with other metal so that two or more kinds of metal are disposed in a layered configuration. In this case, vacuum-evaporation coating technique can be substituted for electroplating.

In the self-tuning material 1, the organic or inorganic bonding materials which fusion-couple the respective metallic chips 2 with one another is desired to be an insulating material which is small in power dissipation even if it is subjected to a high frequency. For example, a thermosetting resin such as polyurethane, epoxy, tetrafluoroethylene (trade mark: TEFLON), polyester, phenol, diallyl phthalate resin and the like, and a ceramic pulverized body, for example, cement powder, glass powder and the like can be exemplified as the bonding materials. When the self-tuning material 1 is operated under a working atmosphere of a high temperature, the bonding materials are desired to be made in the form of porous sintered bodies made from cement powder, glass particles or other ceramic granular bodies.

In a manufacturing apparatus 10 of the self-tuning material 10, as illustrated in FIG. 4, a pair of electrode plates 12, 12 which are identical in their surface areas are opposedly disposed on a horizontal ceramic plate 11 to form a molding frame 14. As shown in FIG. 5, one of the electrode plates 12 has an electric wire 15 connected to a side end thereof from a low-voltage transformer (not shown), and the other electrode plate 12 has an electric wire 16 joined to an opposed side end thereof.

In order to manufacture the self-tuning material 1, a plate of mold releasing material 20, for example, newspaper is placed on the bottom surface of the molding frame 14, and thereafter, the metallic chips 2 and the bonding materials are evenly put into the molding frame 14 after being sufficiently mixed with each other. Moreover, a second sheet of mold releasing material 20 is laid onto the metallic chips and the bonding material which have been put into the molding frame 14.

The self-tuning material thus obtained is considered to be of sufficient porosity provided that the content of the organic or inorganic bonding materials is about 10 weight % or less of the total weight thereof. When said content is 10 to 25 weight %, the self-tuning material 1 is decreased in the electric conductivity and air permeability thereof although it is provided with small pores. Therefore, the content of the metallic chips 2 in the self-tuning material usually is about 75 weight % or more, and is preferably about 90 weight % of the total weight thereof.

Within the molding frame 14 of the manufacturing apparatus 10, the metallic chips 2 and the bonding materials are desired to be 4 to 70 mm in their overall thickness before they are pressurized. In operation, a pressing die 17 is lowered into the molding frame 14, and keeps lowered until the electric current which flows through the molding frame 14 becomes 2,000 to 6,500 amperes, to allow the pressing die 17 to pressurize the metallic chips 2 and the bonding materials generally under pressure of 210 kg/cm$^2$ to 340 ton/cm$^2$. This pressurizing operation is continued for a predetermined period of time. As the electric current flowing through the molding frame 14 keeps substantially constant in the amperage thereof, the molding thus obtained, which is in effect the self-tuning material 1 is brought out of the molding frame. This self-tuning material 1 thus obtained is cut to a variety of dimensions according to usage thereof. For example, it is desired to be generally thinly sliced when the self-tuning material 1 is used for a portable wireless telephone. It is preferably cut to greater size when it is applied to a transmitting or receiving apparatus which uses a radio wave of a lower frequency as television.

In the manufacturing operation of the self-tuning material 1, if it is not produced in the form of a sintered body, the material heating temperature may be lower, and may be such as about 80 to 150° C. Also, the electric current fed through the molding frame 14 may be relatively low in the ampere thereof.

When the metallic chips and the bonding materials are pressurized in the molding frame, an electric current of high ampere and great voltage is applied through the metallic chips and the molding frame within the molding frame. The reason for this is that the electric current can break or rupture the surface film of the resin, namely, the bonding material at each of the junctures of the metallic chips 2, thereby achieving the equalization of the quality of the self-tuning material thus obtained.

As illustrated in FIG. 1 or 3, the self-tuning material 1 is heated under high pressure, whereby the surface diffusion of each metallic chip 2 increases the junctions of the metallic chips 2 to one another, and provides the interiors of a connecting layer 5 with a great number of small pores 6. In each metallic chip 2 of the self-tuning material 1 or 8 as illustrated in FIG. 1 or 3, one ingredient 3 has the compositional element Si of the other ingredient 4 inserted in a belt-shaped configuration in the aluminum matrix thereof, and as a result, the metallic chip 2 is furnished with a layered form of combinational construction of the elements Al and Si. This allows the molten bonding materials to flow into the spacings between every two metal chips in contact with each other, to form the resinous connecting layer 5 furnished with a great number of small pores 6 as a whole.

The self-tuning material 1 is presumed to be subjected to the following electric operation. The self-tuning material 1 is constructed in a net-shaped configuration such that the respective metallic chips 2 are closely joined with one another, and for this reason, an arrival of a radio wave at the self-tuning material 1 allows a slight amperage of electric current to occur therein through the electromagnetic induction. Between the ingredients 3 and 3 or between the ingredients 4 and 4, this electric current of a slight amperage flows without generating any electromotive force, while on the other hand, the electric current creates electromagnetic force when it flows between the ingredients 3 and 4 which differ in their electric charges. The electric current thus spreads to the whole of the self-tuning material 1. As a whole, the self-tuning material is provided with a very great number of electric paths between the ingredients 3 and 4 to allow the electric current to flow. As a result, the self-tuning material 1 has electromagnetic force still more increased, and it is subjected to considerably great electromagnetic force as a whole.

In the self-tuning material 1, since the respective metallic chips 2 are closely joined to one another, the electric current flows through the self-tuning material while widely spreading out over the self-tuning material. That is to say, the self-tuning material 1 is equivalent to a resonance circuit having a coil, a resistor, and a condenser in series connected thereto.

In a high-frequency band in which resonance is occurable, the self-tuning material 1 executes selective amplification on a particular frequency of radio wave, and absorbs faint radio waves of other frequencies. This operation of the self-tuning material becomes still more effective when it has the resonance coil 7 connected thereto.

In the case that the self-tuning material 1 is used as a wave director of a portable wireless telephone, said self-tuning material is cut to size of, for example, 14 mm in length, 24 mm in width and 4 mm in thickness, and the self-tuning material of this size is attached to a digital type portable wireless telephone adjacent to an antenna 31 thereof as shown in FIG. 6. The metallic chips 2 in the self-tuning material 1 include a great number of linear portions through which a slight amperage of electric current flows, to form radio waves which are slightly smaller in wavelength than half wavelength of radio waves emitted or received through the self-tuning material, and as a result, the self-tuning material 1 achieves amplification of radio waves which are to be emitted or have been received through the self-tuning material 1.

The self-tuning material 1 includes, for example, the connecting layer 5 which functions as a dielectric layer, and also, the aluminum elements of one ingredients 3 and the silicon elements of the other ingredients 4, which both ingredients 3 and 4 allow induced currents to flow through them, are located in a layered configuration in the self-tuning material 1. Moreover, the self-tuning material 1 discontinuously includes air of a low dielectric constant in a great number of small pores 6 therein.

In order to use the self-tuning material 1 as a patch antenna of automotive television, the self-tuning material 1 is cut so as to be 10 mm in length, 30 mm in width and 5 mm in thickness, and it is fitted with a connector means (not shown) to be connected to the metallic chips buried therein. In order to attach the self-tuning material 1 to the interior of an automobile, the self-tuning material 1 is fixed on an upper portion or other similar suitable portion of, for example, the windshield or windscreen, and the connector means has an electric feeder wire connected thereto from the automotive television.

In the self-tuning material 1, the antenna is presumed to function for a wide frequency band of radio waves, because a great number of metallic chips 2 are extremely densely coupled with one another in the interior of said self-tuning material, whereby an electric connection is extended substantially evenly over and on a plane on each metallic chip. When a variety of flowing of electric currents occur through aluminum contained in one ingredients 3 of each metallic chip, a great number of distances are created over which the electric currents flow, to form radio waves of length which is equivalent to half wavelength of the radio waves to be emitted.

Also, in the metallic chips 2 which are not electrically connected within them, the electric currents are allowed to flow by using an electromagnetic induction, and the distances over which the electric currents flow are great in number, to create radio waves which are slightly smaller in length than a half wavelength of the radio waves to be emitted. This can be presumed to be the function of such metallic chips in which they serve as wave directors of the antennas.

BRIEF DESCRIPTION OF DRAWINGS

FIG. 7 shows an operating experiment employing the self-tuning material according to the following Example 1.

BEST MODE FOR CARRYING OUT THE INVENTION

The present invention will now be understood by reference to the following examples, however, it will be understood that the present invention is not limited by the following examples, and variations may be made by one skilled in the art without departing from the spirit and scope of the invention.

EXAMPLE 1

As metallic chips 2, shavings of a hyper-eutectic aluminum-silicon alloy including 12% of silicon were used, which have 10 to 30 mesh in the grain size. 95.5 weight % of the shavings and 0.5 weight % of iron powder were mixed and 4 weight % of an epoxy resin in liquid form as a bonding material was added, to obtain viscous mixture.

Figure 4:
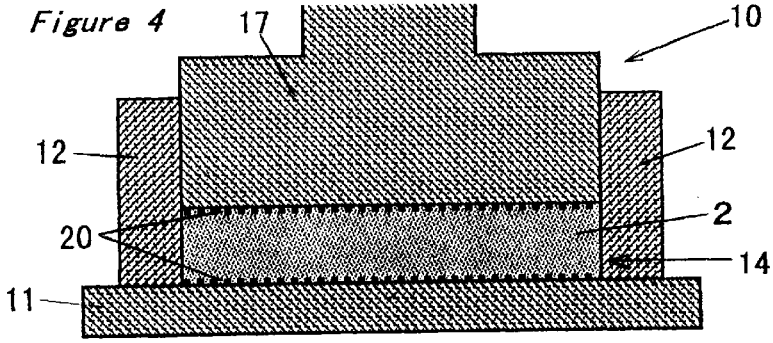
FIG. 4 is a schematic sectional view showing a manufacturing apparatus for the self-tuning material of FIG. 1.
Figure 5:
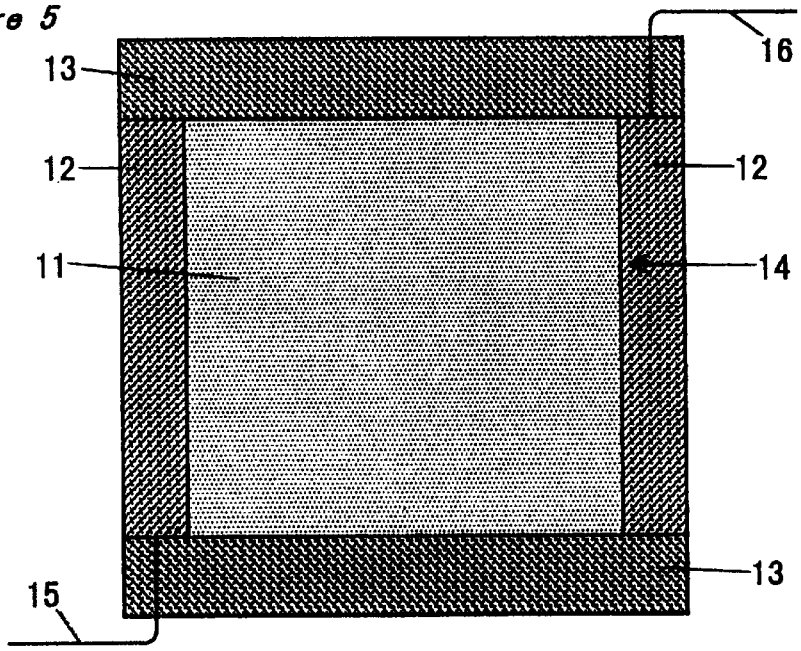
FIG. 5 is a schematic plan view of the manufacturing apparatus of FIG. 4.

In a manufacturing apparatus 10 shown in FIG. 4, a pair of electrode plates 12, 12 in a rectangular-shaped configuration which are identical in their surface areas were opposedly located on a horizontal ceramic plate 11 of heat resistance. As shown in FIG. 5, a pair of heat resisting side walls 13, 13 were disposed on these electrode plates 12, 12 such that the side walls 13, 13 intersect with the electrode plates 12, 12 at right angles, to form a molding frame 14. The molding frame 14 has a bottom area of 300 mm by 600 mm and depth of 50 mm.

As is apparent from FIG. 5, one of the electrode plates 12, 12 had an electric wire 15 connected to a side end thereof from a transformer (not shown) for the use of low voltages, and the other electrode plate 12 had an electric wire connected to an opposite side end thereof. A horizontal ceramic plate 11 had a thermocouple inserted therein, to allow the molding frame 14 to be measured in an inside temperature thereof.

As is shown in FIG. 4, newspapers 20 of 150 grams in weight were flatly placed on the bottom surface of the molding frame 14. Thereafter, the viscous mixture was put into the molding frame 14 such as to be 4 mm in thickness, and this mixture was leveled on the surface thereof. Moreover, newspapers 20 of the same kind as above were flatly placed on the surface of the mixture.

A ceramic pressing die 17 was lowered on the surface of the mixture within the molding frame, while the electric power was turned on to electrify the interior of the molding frame. The pressing die 17 kept lowered until the electric current flowing through the molding frame increases to 20 amperes to a maximum of 3,000 amperes, to allow the mixture to be pressurized. The pressurization was continued under pressure of 120 t/cm$^2$ for 1 minute, and the electric current flowing through the molding frame 14 was gradually decreased, when the mixture was heated to 80 to 120° C. As the molding operation was thus finished, the pressing die 17 was lifted to remove the molding out of the molding frame 14, and then the molding was cooled.

The molding thus obtained was cut to plate of 14 mm in length, 24 mm in width and 4 mm in thickness. Moreover, this molded plate was urethane-coated into a self-tuning material of 15 mm in length, 25 mm in width and 5 mm in thickness.

Figure 6:
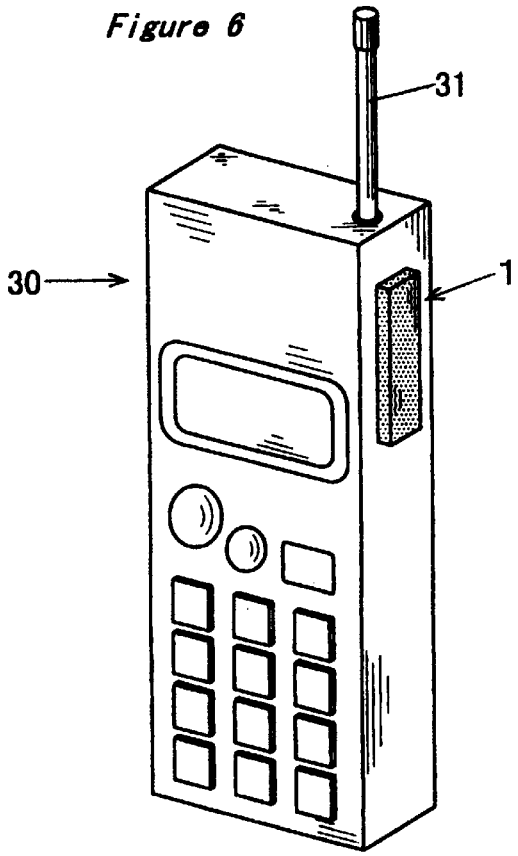
FIG. 6 is a schematic perspective view exemplifying a working state of the self-tuning material of FIG. 1.

In order to use this self-tuning material as a wave director of a portable radio or wireless telephone, the self-tuning material was longitudinally pasted on a telephone extremely adjacent to an antenna 31 thereof by using adhesive tape which has adhesives applied to both sides thereof, as shown in FIG. 6.

For example, the attachment of the self-tuning material to the digital type portable wireless telephone 30 for the use of radio waves of 1.5 GHz in their frequencies allows the telephone 30 to remain feasible of communication without any deterioration in the phonetic quality even if the telephone is moved from Osaka Prefecture to Fukui Prefecture in Japan. Also, the digital type portable wireless telephone fitted with the self-tuning material can provide for an ordinary level of communication even within the manufacturing factories or automobiles in which there is a great deal of noises.

EXAMPLE 2

The shavings of a hyper-eutectic aluminum-silicon alloy, as used in Example 1, was also employed as the metallic chips 2, and were mixed with a powdery urethane resin (10% in content). The mixture thus obtained was 800 grams in the weight thereof.

In the manufacturing apparatus shown in FIG. 4, newspapers 20 were flatly placed on the bottom surface of the molding frame 14. Thereafter, 800 grams of the mixture obtained as described in the foregoing was put into the molding frame 14, and was leveled on the surface thereof. Moreover, newspapers 20 of the same kind as described in the foregoing were also flatly laid on the surface of the mixture.

A ceramic pressing die 17 was lowered onto the surface of the mixture covered with the newspapers within the molding frame, while the electric power was turned on to electrify the interior of the molding frame. The pressing die 17 kept lowered until the electric current flowing through the molding frame increases to about 6,000 amperes, to allow the pressurization of the mixture. For the pressurization, pressure of 70 t/cm$^2$ was exerted upon the internal mixture of the molding frame, and then this mixture was rapidly heated to 1,200° C. Thereupon, the electric current which flows through the molding frame was gradually decreased. The reason for this is that the Al—Si alloy in a highly heated condition was oxidized on the surface thereof with the atmospheric oxygen, to increase the electric resistance thereof. After the mixture had been rapidly heated to 1,200° C., the ceramic pressing die 17 was lifted to remove the sintered molded plate out of the molding frame 14, and then the molding was cooled.

The sintered molded plate thus obtained was cut to size of 10 mm in length, 30 mm in length and 5 mm in thickness, and a connector means (not shown) was connected thereto to use it in the form of a patch antenna for an automotive television. The sintered molded plate, which is in effect the self-tuning material was an upper inside portion of the windshield or windscreen of an automobile, and had an electric feeder wire connected to the connector means thereof from a television loaded on the automobile.

This automotive television fitted with the self-tuning material remains satisfactory in the reception thereof, when it is moved along the skirts of mountains or into tunnels of small distances together with the automobile on which the television is loaded. Also, this television remains substantially unchanged in the reception thereof even if the automobile having the television loaded thereof is changed in the advancing direction thereof.

This patch antenna allows the television to be better in the reception thereof under a ultrahigh frequency of small wavelength of televisual radio waves than under a very high frequency of televisual radio waves.

Although being not illustrated, the self-tuning material 1 cut to size of 4.5 mm in length, 10 mm in width and 2.5 mm in thickness was effective to improve the performance of an analogue type cordless telephone for the use of a small amperage of electric current, which is usually not more than 100 meters in the communication coverage thereof. In this case, the self-tuning material was pasted on each of the parent machine and the child machine which together form a set of the analogue type cordless telephone.

This cordless telephone was experimentally found to allow communication over a linear distance of nearly 300 meters, when it was moved into a concrete building from a wooden house.

In the analogue type cordless telephone fitted with the self-tuning material, communication was thus feasible over a greater distance than in the analogue type cordless telephone which is not equipped with the self-tuning material. This is true of a simple type portable telephone called PHS (Personal Handy Phone System) in Japan which is a digital type cordless telephone.

EXAMPLE 3

Figure 1:
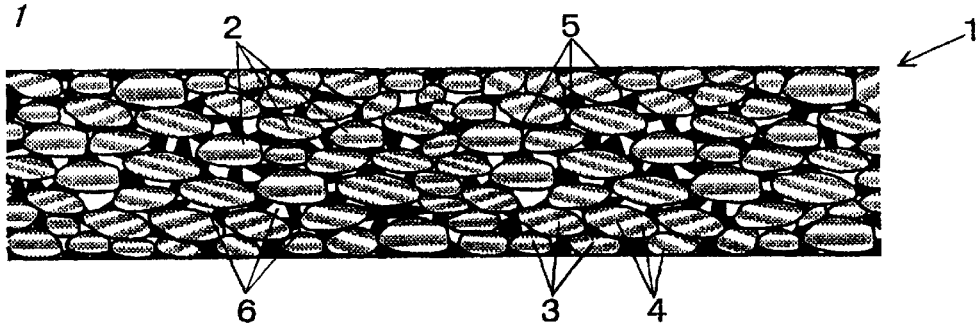
FIG. 1 is a schematic sectional view exemplifying the self-tuning material in a plate-shaped configuration according to the present invention, in which component metallic chips are enlargedly depicted more schematically than the real metallic chips.
Figure 2:
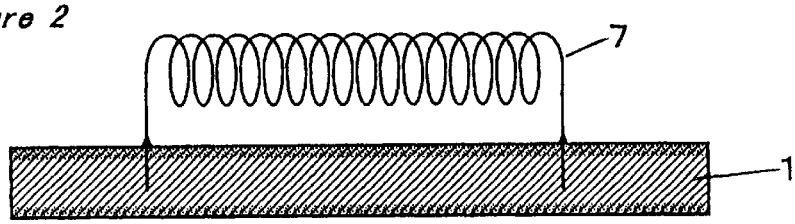
FIG. 2 is a schematic sectional view showing a modification of the plate-shaped self-tuning material of FIG. 1, which has a resonance coil connected thereto.
Figure 3:
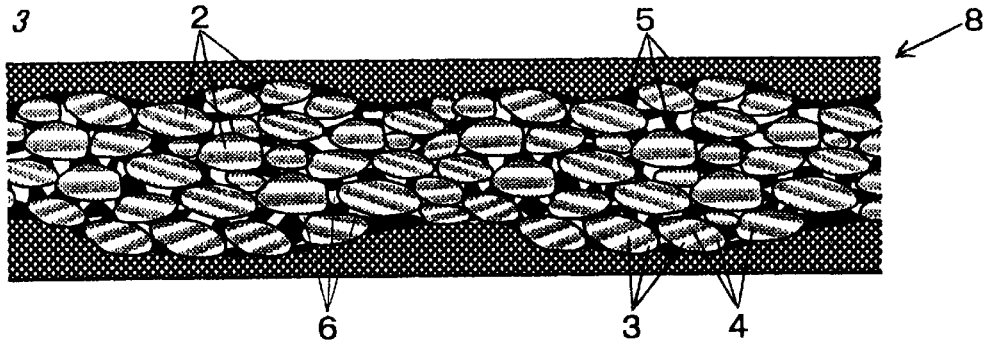
FIG. 3 is a schematic sectional view showing a modification of the self-tuning material, in which it is made of aporous sintered body, and the metallic chips are enlargedly illustrated more schematically than the real metallic chips.

The sintered molded plate obtained in Example 2 was cut to size of 4.5 mm in length, 10 mm in width and 2.5 mm in thickness, and as shown in FIG. 2, it has both ends of the coil 7 connected thereto, which resonates with frequencies of 700 to 900 MHz. This coil functions to achieve greater amplification of radio waves to be emitted through the self-tuning material, and attains more effective absorption of other radio waves of feeble frequencies.

In order to use this self-tuning material as a wave director for emitting the radio waves from a digital type portable wireless telephone, the self-tuning material was longitudinally pasted on the digital type portable wireless telephone 30 extremely adjacent to the antenna 31 thereof by using adhesive tape which has adhesives applied to both sides thereof.

As any of portable wireless telephones was arranged to have this self-tuning material internally attached thereto by a manufacturer thereof, it was more effective to improve the performance of any portable wireless telephones.

EXAMPLE 4

In order to obtain a modified sintered body of porosity, 17 kg of shavings of cast iron (specified as "FC-25" in the Japanese Industrial Standard which contains carbon of about 3.5%, silicon of about 2.5%, and manganese of about 0.5%) were used as the metallic chips. The shavings were mixed with powdery epoxy resins of 1 kg which serve as the bonding material. The mixture thus formed was subsequently treated as described for Example 2 except that the electrification of the molding frame was brought to a stop when the internal temperature of the molding frame 14 became constant in 1 to 2 minutes after the metallic chips and the bonding materials had been pressurized within the molding frame. The pressurization was continued until these molding materials are formed into a molded plate of predetermined thickness, and thereafter, the pressing die 17 was lifted to remove out of the molding frame the sintered plate thus molded.

The molded sintered plate thus obtained was left in the atmosphere to cool it after being removed out of the molding frame. This plate is resistant against heat, and is light in weight because it is porous.

In the place of the cast iron shavings, shavings of plain steel (carbon content: 2.5 to 4.5%) may be used as the metallic chips, and glass powders of 1 mm in their average diameters or ceramic powders may be substituted for the epoxy resin as the bonding material.

Next, in order to demonstrate the operation and effect of the present invention, the following experiments were executed by using the self-tuning material manufactured in Example 1.

Experiment 1

A single piece of the self-tuning material was affixed to a digital type portable wireless telephone for radio waves of 800 MHz in frequency band. In this case, the definite position for affixing the self-tuning material is as shown in FIG. 6.

Figure 7A:
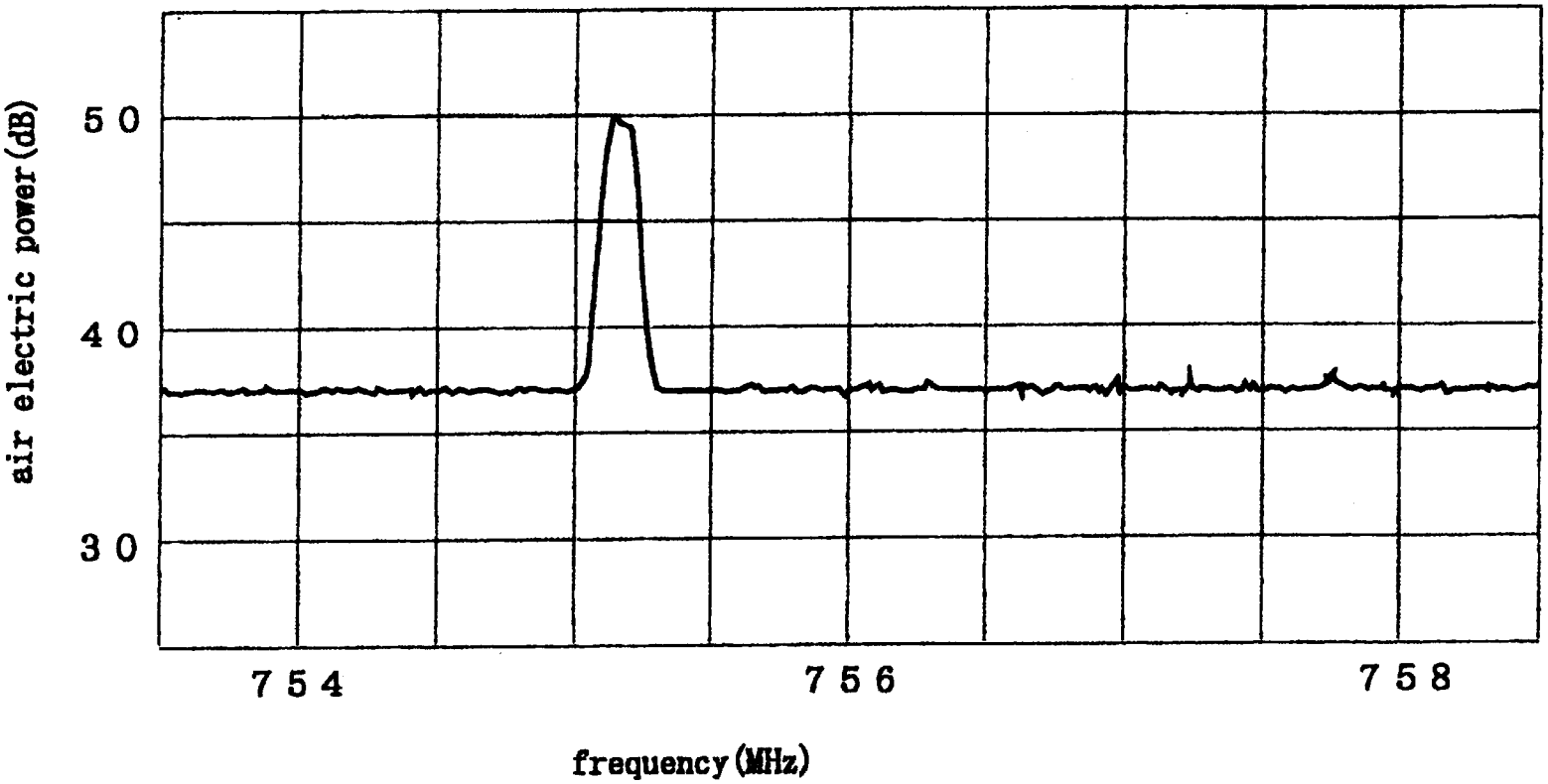
FIG. 7*a* is a graph of the frequencies of the radio waves emitted by a portable wireless telephone which is fitted with the self-tuning material and FIG. 7*b* is a graph of the frequencies of the radio waves emitted by a portable wireless telephone which is not fitted with the self-tuning material.
Figure 7B:
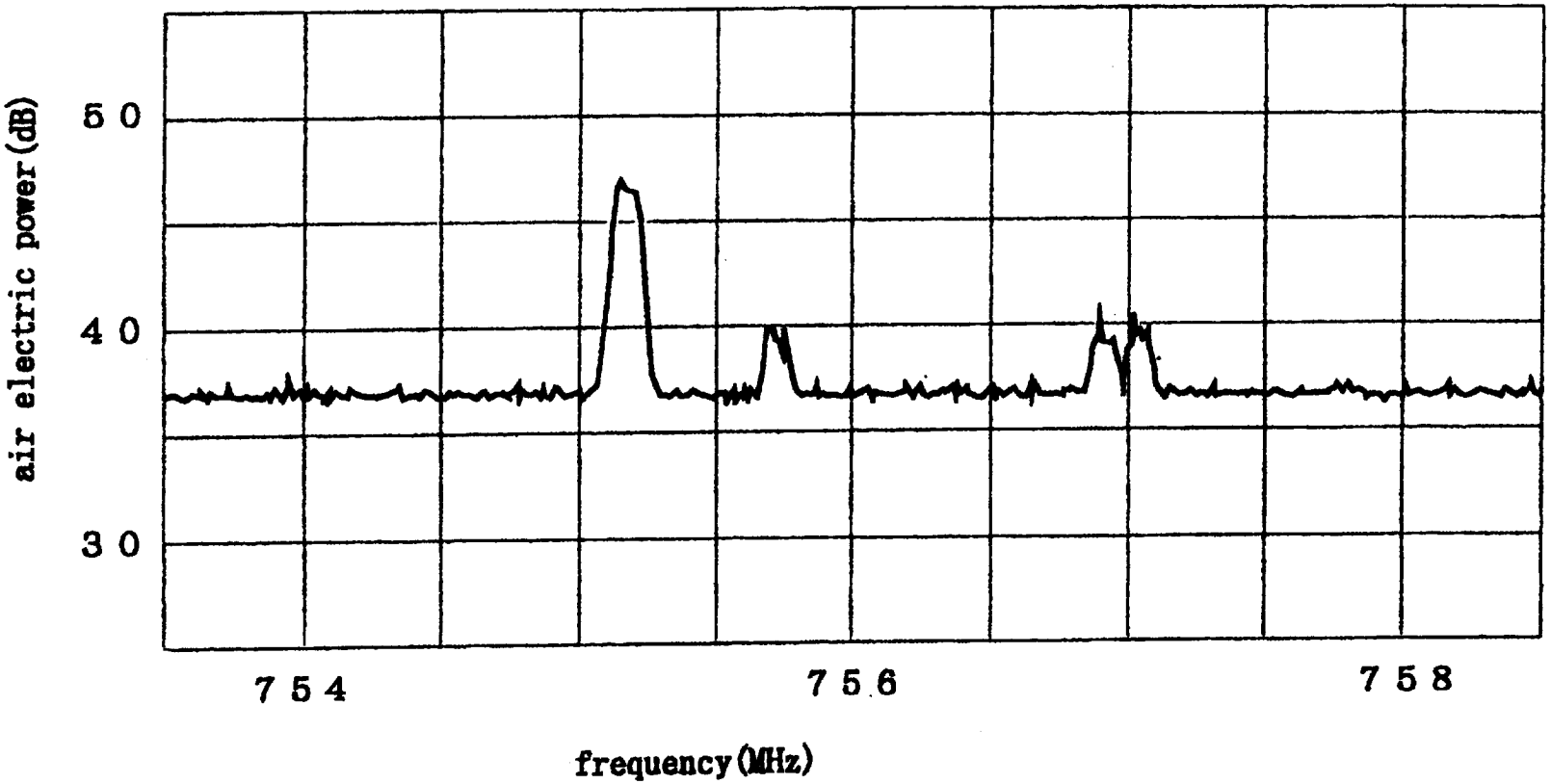

This portable telephone was measured in the emitted radio waves thereof for 300 milliseconds in an anechoic room for radio waves, and for comparison, a portable wireless telephone which was not fitted with any self-tuning material was also subjected to measurement of radio waves emitted thereby in the same anechoic room. As a result, the portable telephone fitted with the self-tuning material proved to emit radio waves of 755.135 MHz in their frequencies. FIG. 7*a* is a graph which shows the frequencies of the radio waves emitted by the portable wireless telephone fitted with the self-tuning material. FIG. 7*b* also graphically shows the frequencies of the radio waves emitted by the portable wireless telephone which is not fitted with the self-tuning material.

From FIG. 7*a* it is understood that the portable wireless telephone fitted with the self-tuning material has a peak value of 49.90 dBuV in the frequencies of the radio waves emitted thereby, and this peak value is apparently superior to a peak value of 43.80 dBuV in the frequencies of the radio waves emitted by the portable wireless telephone which is not mounted with the self-tuning material.

FIG. 7*a* also shows that in the portable wireless telephone fitted with the self-tuning material, the frequencies of the radio waves emitted thereby remains constant, and the radio waves emitted thereby are stabilized in their condition, while on the other hand, the portable wireless telephone having no self-tuning material attached thereto creates radio waves of frequencies which are approximate to the particular frequencies to be intended to be emitted, thereby causing unstable condition of radio waves emitted.

Experiment 2

A simple wave measuring instrument ("Trifield Meter") was used to conduct the following experiment.

A portable wireless telephone (trade mark: MITSUBISI DII) was fitted with a single piece of the self-tuning material adjacent to the speaker portion thereof. The amount of electromagnetic waves which leaked from the speaker area of this telephone while it was in operation was measured, and it was found to be approximately 1 mG.

On the other hand, with the self-tuning material removed from this telephone, the leakage of electromagnetic waves from the speaker area thereof measured 100 mG while it was in operation.

Similarly, a different portable wireless telephone (trade mark: PANASONIC DP141) fitted with the self-tuning material was measured in the leakage of electromagnetic waves from the speaker area thereof while it was in operation, and this leakage was found to be 10 mG to 15 mG, whereas this portable wireless telephone without any self-tuning material measured 100 mG or more in the of electromagnetic waves from the speaker area thereof while being in operation.

These experimental results show that the self-tuning material produce an absorbing effect upon radio waves which are unnecessary to allow the portable wireless telephone to maintain high quality of communication in a high-frequency band of radio waves.

Experiment 3

A voltmeter was used to perform the following experiment. A portable wireless telephone (trade mark: PANASONIC DP141) was fitted with a single piece of the self-tuning material adjacent to the speaker portion thereof. In this telephone, voltage generated by means of the leaked electromagnetic waves measured +0.1 to +0.6 mV. On the other hand, in the same telephone free from the self-tuning material, the leaked electromagnetic waves were found to create voltage of −1 to +3.6 mV.

These experimental results denote that the self-tuning material according to the present invention has effects in which leakage of electromagnetic waves from the portable wireless telephone is decreased, and the radio waves emitted from the telephone are increased.

Industrial Applicability

Although the self-tuning material of the present invention is simple in the construction thereof, and is small in the dimension thereof, this self-tuning material forms a resonance circuit to particular radio waves to perform selective amplification upon them, whereby the self-tuning material can be used in the form of a patch antenna or a wave director for radio or wireless communicating devices for the use of a microwave band or millimetric wave band of the radio waves.

Also, this self-tuning material is a considerably small-sized plate, and therefore, the attachment thereof to a mobile type communication device scarcely becomes an obstacle to a user of the communication device. Moreover, from the viewpoint of the application of the self-tuning material to the patch antenna, it is an advantage that a limited small space suffices for mounting the self-tuning material to the communication device. In addition, even if the direction in which radio waves of a microwave band or millimetric wave band are emitted or received does not always remain constant, the self-tuning material is convenient in that it is not required to be changed in the angle at which it is located in a portable wireless telephone, each time the direction in which the radio waves are to be emitted or have received alters when, for example, the self-tuning material is moved together with an automobile in which a portable wireless telephone fitted therewith is loaded.

As the self-tuning material of the present invention is attached to a mobile type communication device, the communication device can execute radio or wireless communication without strengthening the radio waves to be emitted thereby even if the antenna thereof is not stretched.

By connecting a resonance coil to the self-tuning material, this self-tuning material more enhances amplifying operation thereof for particular radio waves to allow the communication device fitted therewith to conduct communication under feeble radio waves, whereby it is feasible to enlarge band width of frequencies in which radio or wireless communication can be executed in an area of an identical number of radio stations.

This self-tuning material is free from any influence of an increase in the amount of radio waves emitted by a radio or wireless communication device, and therefore, it is unnecessary to allow for an evil effect of an increased amount in radio waves emitted thereby upon human bodies.

In a band of high frequencies such as a microwave band or millimetric wave band, the self-tuning material according to the present invention selectively amplifies radio waves of particular frequencies, and absorbs radio waves of other frequencies than particular frequencies, to stabilize the condition of the radio waves emitted or received through the self-tuning material.

As the self-tuning material furnished with such properties is applied to a portable wireless telephone, the portable wireless telephone is allowed to prevent the emission or reception of any unnecessary radio waves, whereby the telephone is hardly influenced by environmental noises. As a result, the telephone enables communication within manufacturing factories or automobiles which include a great deal of noises, and can diminish trouble of malfunction of medical equipments in general hospitals in which electronic machines or facilities of high performance are located.

In the manufacturing method according to the present invention, the mechanical properties and air permeability of the self-tuning material can be adjusted by changing the quality and configurations of the metallic chips and the bonding materials, the mixing ratio of the metallic chips and the bonding materials with each other, the pressure which is exerted upon the metallic chips and the bonding materials while the metallic chips and the bonding materials are heated, the temperature of the heating operation accompanied by the pressurizing operation to the metallic chips and the bonding materials, and other conditions on which the self-tuning materials are manufactured. This achieves manufacturing of the self-tuning materials which are suitable for the applicable frequencies of radio or wireless communication devices.

The application of this method according to the present invention can freely provide for either of the self-tuning materials in the form of simple continued bodies of the metallic chips which are relatively low in their strength, and those which are porous sintered bodies of high mechanical strength.

The resin from which the bonding materials are made to form the bonding material may be increased in the additive amount thereof to allow the self-tuning material to be transformable.

Therefore, it is preferable that the self-tuning materials in the form of simple continued bodies of the metallic chips are applied to portions of radio or wireless communication devices which do not require the self-tuning materials to be furnished with mechanical strength, and the self-tuning materials comprising the porous sintered bodies are used for radio or wireless communication devices which are operated in severe service environments of, for example, high temperatures and high humidity.

I claim:

1. A self-tuning material for selectively amplifying a particular radio wave emitted therefrom or received therein comprising:

a plurality of metallic chips densely coupled to one another;

each metallic chip containing at least two kinds of ingredients differing in electrical charge;

each metallic chip being at least 40 mesh grain size;

a bonding material joining said metallic chips to one another; and said self-tuning material having a porous metallic structure strengthened with said bonding material, in which m internal resonant circuit is generated by a small current going through said self-tuning material with electromagnetic induction upon arrival of said particular radio wave.

2. A self-tuning material as claimed in claim 1 further comprising a coil resonating with a desired frequency fixably mounted to said metallic chips.

3. A self-tuning material as claimed in claim 1 wherein:

said metallic chips are each a hyper-eutictic aluminum-silicon alloy; and said bonding material is a thermosetting resin.

4. A self-tuning material as claimed in claim 1 wherein said metallic chips are densely coupled to one another on a plurality of connecting points through surface diffusion.

5. A self-tuning material as claimed in claim 1 wherein the content of said metallic chips is at least about 75 weight percent of said self-tuning material.

6. A self-tuning material as claimed in claim 1 wherein:

said self-tuning material is formed in a plate-shaped configuration; and said metallic chips are 10 to 40 mesh grain size.

* * * * *